US011004293B2

(12) United States Patent
Schletti et al.

(10) Patent No.: US 11,004,293 B2
(45) Date of Patent: May 11, 2021

(54) METHOD AND DEVICE FOR CHECKING A VALUE DOCUMENT

(71) Applicant: CI Tech Sensors AG, Burgdorf (CH)

(72) Inventors: Reto Schletti, Burgdorf (CH); Moritz Julen, Burgdorf (CH); Thomas Boos, Burgdorf (CH)

(73) Assignee: CI Tech Sensors AG, Burgdorf (CH)

( * ) Notice: Subject to any disclaimer, the term of this patent is extended or adjusted under 35 U.S.C. 154(b) by 0 days.

(21) Appl. No.: 16/224,238

(22) Filed: Dec. 18, 2018

(65) Prior Publication Data

US 2019/0221065 A1 Jul. 18, 2019

(30) Foreign Application Priority Data

Dec. 22, 2017 (EP) ..... 17210084

(51) Int. Cl.

| | |
|---|---|
| ***G07D 7/206*** | (2016.01) |
| ***G07D 7/121*** | (2016.01) |
| ***G07D 7/12*** | (2016.01) |
| ***G07D 7/20*** | (2016.01) |
| ***G07D 7/17*** | (2016.01) |

(52) U.S. Cl.

CPC ..... *G07D 7/206* (2017.05); *G07D 7/12* (2013.01); *G07D 7/121* (2013.01); *G07D 7/17* (2017.05); *G07D 7/2008* (2013.01); *G07D 7/2016* (2013.01)

(58) Field of Classification Search

CPC ..... G07D 7/2008; G07D 7/17; G07D 7/121; G07D 7/2016; G07D 7/12

USPC ..... 382/135, 137, 209, 112

See application file for complete search history.

(56) References Cited

U.S. PATENT DOCUMENTS

| | | | | |
|---|---|---|---|---|
| 2009/0324053 | A1 | 12/2009 | Ross | |
| 2010/0092084 | A1* | 4/2010 | Perronnin | G06K 9/00442 382/170 |
| 2010/0128964 | A1 | 5/2010 | Blair | |
| 2011/0164805 | A1* | 7/2011 | Blair | G07D 7/202 382/137 |
| 2014/0002872 | A1* | 1/2014 | Cook | G06T 5/50 358/504 |

(Continued)

OTHER PUBLICATIONS

Extended European Search Report filed in corresponding European Application; 7 pages.

*Primary Examiner* — Congvan Tran

(74) *Attorney, Agent, or Firm* — Black, McCuskey, Souers & Arbaugh LPA

(57) ABSTRACT

A method for testing a valuable document including illuminating the valuable document line by line such that a first group of lines is illuminated with light of a first wavelength and a second group of lines is illuminated with light of a second wavelength, reflection light that is reflected from the lines and/or transmission light that passes through the lines. First data are representative of the reflection light and/or transmission light assigned to the lines of the first group and second data are representative of the reflection light and/or transmission light assigned to the lines of the second group. Further, processing the first data such that a first image generated from the first data has a first resolution, and the second data such that a further image generated from the second data has a second resolution, comparing the first and second images with first and further reference images.

14 Claims, 6 Drawing Sheets

(56) References Cited

U.S. PATENT DOCUMENTS

2014/0119616 A1* 5/2014 Wooldridge ..... G06K 9/00463
382/112
2015/0310689 A1* 10/2015 Parkov ..... G06K 9/2018
382/135

* cited by examiner

METHOD AND DEVICE FOR CHECKING A VALUE DOCUMENT

CROSS-REFERENCE TO RELATED APPLICATION

This application claims priority to and claims the benefit of European Patent Application Serial No. 17 210 084.4, which was filed Dec. 22, 2017.

TECHNICAL FIELD

The invention relates to a method and a device for testing a valuable document.

BACKGROUND

It is known to test a valuable document, for example a banknote, a cheque, an identity card, a passport, a ticket or a share document, for various reasons. By way of example, it may be necessary to test that the valuable document is genuine. A device for testing the valuable document can for example be integrated in an automated teller machine or be a standalone device that can be used for example in a bank or in a business. Besides testing the authenticity of the valuable document, it may be necessary to test the state of the valuable document. This is also called a "fitness test". The fitness test involves for example checking the extent to which the valuable document is contaminated and/or damaged.

Both for testing the authenticity and for testing the fitness of the valuable document it is known to illuminate the valuable document alternately with light of different colours and to detect the light reflected from the valuable document and/or the light transmitted through the valuable document. The image recorded from the valuable document in this way can then be compared with one or more corresponding reference images. This comparison involves comparing in particular special authenticity features and/or fitness features of the valuable document with the corresponding authenticity features and/or fitness features of the reference image. What is problematic here is that for the comparison of specific authenticity features and/or fitness features, the image of the valuable document should have a high resolution and a correspondingly large amount of storage space has to be kept available for the image. An additional factor is that in general a plurality of authenticity features and/or fitness features have to be tested per valuable document and that the demand for storage space is multiplied as a result. Moreover, a high computing power is required for processing the high-resolution image(s) and for the comparison with the reference image(s). Therefore, conventional methods and devices for testing a valuable document are very complex.

SUMMARY

One object of the invention is to provide a method for testing a valuable document which is implementable in a simple manner and/or by means of a simple device.

One object of the invention is to provide a device for testing a valuable document which is configured in a simple manner.

One object of the invention is achieved by means of a method for testing a valuable document, wherein: the valuable document is illuminated line by line in such a way that a first group of lines of the valuable document is illuminated with light of a first wavelength and that at least one second group of lines of the valuable document is illuminated with light of a second wavelength, wherein at least partly lines of the first group and lines of the second group alternate, reflection light that is reflected from the lines and/or transmission light that passes through the lines are/is detected in a manner assigned to the lines of the first group and the lines of the second group, wherein first data are representative of the reflection light and/or transmission light assigned to the lines of the first group and second data are representative of the reflection light and/or transmission light assigned to the lines of the second group, the first data are processed in such a way that a first image generated from the first data has a first resolution, and the second data are processed in such a way that a further image generated from the second data has a second resolution, which is different from the first resolution, and the first image is compared with a first reference image and the further image is compared with a further reference image.

Testing the valuable document is thus carried out with the aid of different images of the valuable document, wherein the corresponding images are recorded under illumination by means of light of correspondingly different wavelengths, that is to say of correspondingly different colours. Special features of the valuable document are suitable for the comparison the corresponding reference images, wherein a respective image that was recorded under illumination by means of light of a specific colour is particularly suitable for the comparison of said features. By way of example, an image that was recorded under illumination with light of a first colour is particularly well suited to the comparison of a first feature, and an image that was recorded under illumination with light of a second colour is particularly well suited to the comparison of a second feature. One aspect, therefore, is that one specific colour is particularly well suited to testing one specific feature, that another colour is particularly well suited to testing another feature, and that the colour that is particularly well suited to the corresponding feature is used for each feature to be tested. By way of example, a feature that reveals what the valuable document actually is, for example what denomination the corresponding banknote has, can be identified particularly well under illumination with red and/or green light. In contrast thereto, contamination that is an indication of the fitness of the valuable document 22 can be identified particularly well under illumination with blue light.

In addition, different minimum resolutions of the images are required for the comparison of the features. By way of example, the first image having at least the first resolution is required for the comparison of the first feature and the second image having at least the second resolution is required for the comparison of the second feature. Therefore, processing the data in such a way that the images have different resolutions makes it possible not to process every image with the maximum possible resolution. In particular, it is possible, for comparing a first feature, to use an image having a lower resolution than an image used for comparing a second feature. By way of example, the minimum resolution necessary in each case can be used for comparing all the features. One aspect, therefore, is that one specific minimum resolution is necessary for testing one specific feature, that another specific minimum resolution is necessary for testing another feature, and that the resolution actually used for each image is low, preferably the corresponding minimum resolution.

This contributes to the fact that the features can be tested particularly simply and precisely and to the fact that a low computing power is required for processing the images and for the comparison with the corresponding reference images, whereby the method for testing the valuable document is implementable in a simple manner and/or by means of a simple device.

The lines of the first group are all illuminated with light of the first wavelength, that is to say with light of a first colour. The lines of the first group can also be referred to as first lines or as lines of the first colour. If the first colour is red, for example, then the first lines can be referred to as red lines. The lines of the second group are all illuminated with light of the second wavelength, that is to say with light of a second colour. The lines of the second group can also be referred to as second lines or as lines of the second colour. If the second colour is green, for example, then the second lines can be referred to as green lines. In addition, the valuable document can be illuminated with light of further wavelengths, such that further groups of lines are generated.

Specific features of the valuable document are primarily used for the comparison of the images with the reference images. Said features can be for example authenticity features for testing the authenticity of a valuable document or fitness features for testing the fitness of a valuable document. Authenticity features can be for example watermarks, reflective regions and/or regions that are luminous under corresponding illumination. A fitness feature can be for example contamination of the valuable document. In accordance with one development, the first image shows a first number of lines of the first group, wherein the first data are additionally processed such that at least one second image generated from the first data shows a smaller number of lines of the first group and has a resolution that is correspondingly lower than the first resolution, and wherein the second image is compared with a corresponding second reference image. This makes it possible, firstly, on the basis of the lines of the first group, to generate two different images which can be used for the comparison of correspondingly two different features, and, secondly, to use in each case only images having a small number of lines, for example the minimum required number of lines, for these two comparisons. This furthermore makes a contribution to the fact that an even lower computing power is required for processing the images and for the comparison with the corresponding reference images, whereby the method for testing the valuable document is implementable in an even simpler manner and/or by means of an even simpler device.

In accordance with one development, the first data are additionally processed such that at least partly first data of successive lines of the first group are averaged and that at least one second image generated from these averaged data has a resolution lower than the first resolution, wherein the second image is compared with a corresponding second reference image. This makes it possible, firstly, on the basis of the lines of the first group, to generate two different images which can be used for the comparison of correspondingly two different features, and, secondly, to use in each case only images having a small resolution, for example the minimum required resolution, for these two comparisons. This furthermore makes a contribution to the fact that an even lower computing power is required for processing the images and for the comparison with the corresponding reference images, whereby the method for testing the valuable document is implementable in an even simpler manner and/or by means of an even simpler device. The two developments explained above can also be combined with one another. In particular, the first data can additionally be processed such that the second image generated from the first data shows a smaller number of lines of the first group than the first image and that at least partly first data of successive lines of the first group are averaged for the second image, such that the corresponding second image has a resolution that is lower than the first resolution.

In accordance with one development, the valuable document is moved in a movement direction relative to an illumination unit, by means of which the valuable document is illuminated, and the valuable document is illuminated in such a way that the lines are aligned perpendicular to the movement direction. This makes it possible in a simple manner gradually to illuminate the entire valuable document with progressive movement.

In accordance with one development, the first resolution or the second resolution corresponds to a native resolution of a detector for detecting the reflection light and/or transmission light. The native resolution corresponds exactly to the physical digital resolution, that is to say the number of pixels, of the detector. The detector is for example a line detector and accordingly comprises only one line of pixels. A sensor unit in which the detector is arranged can also be referred to as a camera.

In accordance with one development, the valuable document is a banknote, a cheque, an identity card, a passport, a ticket or a share document.

One object of the invention is achieved by means of a device for testing the authenticity of the valuable document, comprising: an illumination unit for illuminating the valuable document line by line in such a way that the first group of lines of the valuable document is illuminated with light of the first wavelength and that at least the second group of lines of the valuable document is illuminated with light of the second wavelength, wherein at least partly lines of the first group and lines of the second group alternate, the detector for detecting reflection light that is reflected from the lines, and/or transmission light that passes through the lines, in a manner assigned to the lines of the first group and the lines of the second group, wherein the first data are representative of the reflection light and/or transmission light assigned to the lines of the first group and the second data are representative of the reflection light and/or transmission light assigned to the lines of the second group, a data processing unit for processing the first data in such a way that the first image generated from the first data has the first resolution, and for processing the second data in such a way that the second image generated from the second data has the second resolution, which is different from the first resolution, and an evaluation unit, which compares the first image with the first reference image and the second image with the second reference image.

The effects, advantages and developments explained above in association with the method for testing the valuable document can readily be applied to the device for testing the valuable document. Therefore, at this juncture, a renewed presentation of said effects, advantages and developments is dispensed with and reference is merely made to the explanations above.

In accordance with one development, the first image shows the first number of lines of the first group and the data processing unit additionally processes the first data such that at least the second image generated from the first data shows the smaller number of lines of the first group and has the resolution that is correspondingly lower than the first resolution, and the evaluation unit compares the second image with the corresponding second reference image.

In accordance with one development, the data processing unit additionally processes the first data such that at least partly first data of successive lines of the first group are averaged and that at least one second image generated from these averaged data has a resolution lower than the first resolution, and the evaluation unit compares the second image with a corresponding second reference image.

The two developments explained above can also be combined with one another. In particular, the first data can additionally be processed such that the second image generated from the first data shows a smaller number of lines of the first group than the first image and that at least partly first data of successive lines of the first group are averaged for the second image, such that the corresponding second image has a resolution that is lower than the first resolution.

In accordance with one development, the device comprises a transport unit, by means of which the valuable document is moved in a movement direction relative to the illumination unit, wherein the valuable document is moved and illuminated in such a way that the lines are aligned perpendicular to the direction of movement.

In accordance with one development, the first resolution or the second resolution corresponds to a native resolution of the camera for detecting the reflection light and/or transmission light.

BRIEF DESCRIPTION OF THE DRAWINGS

In accordance with one development, the valuable document is a banknote, a cheque, an identity card, a passport, a ticket or a share document. Exemplary embodiments of the invention are illustrated in the figures and are explained in greater detail below.

DESCRIPTION

In the following detailed description, reference is made to the accompanying drawings, which form part of this description and show for illustration purposes specific exemplary embodiments in which the invention can be implemented. Since components of exemplary embodiments can be positioned in a number of different orientations, the direction terminology serves for illustration and is not restrictive in any way whatsoever. It goes without saying that other exemplary embodiments can be used and structural or logical changes can be made, without departing from the scope of protection of the present invention. It goes without saying that the features of the various exemplary embodiments described herein can be combined with one another, unless specifically indicated otherwise. Therefore, the following detailed description should not be interpreted in a restrictive sense, and the scope of protection of the present invention is defined by the appended claims. In the figures, identical or similar elements are provided with identical reference signs, in so far as this is expedient.

Valuable documents such as security papers or e.g. banknotes, cheques, shares, papers having a security imprint, certificates, identity cards, passports, entrance tickets, travel tickets, vouchers, identification or access cards or the like can be provided with security features on their front side, their rear side and/or in a manner embedded in the material, in order to hamper or to prevent forgery thereof, and to be able to check the authenticity thereof. In the case of a banknote, for example, one type of security features may be a region printed with luminescent (e.g. phosphorescent and/or fluorescent) ink. Since the luminescence, the reflection and/or transmission behaviour of such a region of the banknote can be imitated only with high expenditure, this constitutes an effective security feature which, at the same time, is machine-testable.

Figure 1:
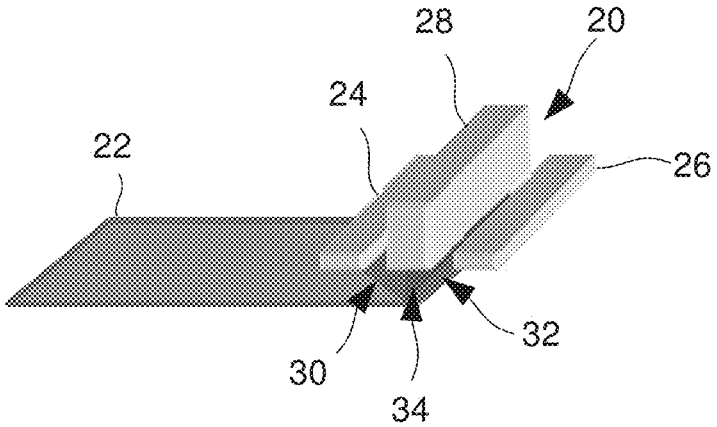
FIG. 1 shows a perspective illustration of one exemplary embodiment of a device for testing a valuable document with reflective illumination.

FIG. 1 shows a perspective illustration of one exemplary embodiment of a device 20 for testing a valuable document 22. The device 20 is suitable in particular for testing an authenticity and/or a state, the so-called fitness, of the valuable document 22.

The device 20 comprises a first illumination unit 24. The first illumination unit 24 serves for illuminating the valuable document 22 at a first angle. Optionally, the first device 20 comprises a second illumination unit 26. The second illumination unit 26 serves for illuminating the valuable document 22 at a second angle. By means of the illumination units 24, 26, the valuable document 22 can be illuminated in reflected light.

The valuable document 22 shown in FIG. 1 has two longitudinal sides, which extend from left to right in FIG. 1, and two transverse sides, which are arranged perpendicular to the longitudinal sides, are shorter than the longitudinal sides and extend into the plane of the drawing in FIG. 1. In the exemplary embodiment illustrated in FIG. 1, the illumination units 24, 26 and the sensor unit are also configured in elongate fashion, wherein their longitudinal sides extend perpendicular to the longitudinal sides of the valuable document 22. Expressed illustratively, the device 20 is aligned perpendicular to the valuable document 22. This brief discourse on the outer shapes and alignments of the valuable document 22 and of the device 20 serves merely to be able to precisely describe individual features and the spatial arrangement thereof hereinafter. In other embodiments, the valuable document 22 and/or the device can be configured differently and/or arranged differently with respect to one another.

The device 20 furthermore comprises a sensor unit 28. The sensor unit 28 serves for detecting light, for example reflection light, which is reflected from the valuable document 22 owing to the illumination of the valuable document 22.

Furthermore, the device 20 comprises a transport unit, which is not illustrated in FIG. 1, by means of which the valuable document 22 can be moved relative to the device 20. By way of example, the transport unit moves the valuable document 22 while the device 20 remains stationary. As an alternative thereto, the valuable document 22 can remain stationary while the device 20 moves by means of the transport unit. In both cases the valuable document 22 is moved relative to the device 20 in such a way that the entire valuable document is illuminated in the course of the movement.

Figure 2:
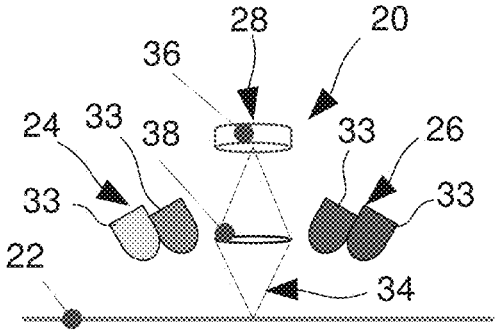
FIG. 2 shows a lateral schematic illustration of the device for testing a valuable document with reflective illumination in accordance with FIG. 1.

FIG. 2 shows a lateral schematic illustration of the device 20 for testing the valuable document 22 in accordance with FIG. 1. It is evident from FIG. 2 that the illumination units 24, 26 each comprise at least one, preferably a plurality of light sources 33. By way of example, the illumination units 24, 26 each comprise at least one, for example two lines comprising respectively a plurality of light sources 33. If appropriate, the two lines of light sources 33 of one of the illumination units 24, 26 can be parallel to one another. Alternatively or additionally, one or both lines of light sources 33 can be parallel to the longitudinal side of the corresponding illumination unit 24, 26. Alternatively or additionally, one or both lines of light sources 33 of one of the illumination units 24, 26 can be arranged perpendicular to the longitudinal direction of the valuable document 22. In the exemplary embodiment shown in FIG. 2, the lines of light sources 33 extend into the plane of the drawing, such that the light sources 33 shown in FIG. 2 are in each case representative of one of said lines of light sources 33. The light sources 33 can for example each comprise one, two or more light-emitting diodes.

The sensor unit 28 comprises a detector 36 and an optical element 38. The detector 36 is a line detector comprising a plurality of pixels, not shown in FIG. 2. The pixels are arranged along a line, wherein the corresponding line extends into the plane of the drawing in the exemplary embodiment shown in FIG. 2. The optical element 38 can comprise a focusing lens, for example, which focuses the light coming from the valuable document 22, for example the reflection light, and directs it onto the detector 36. The optical element 38 can for example be extruded and extend parallel to the detector 36 into the plane of the drawing. As an alternative thereto, the optical element 38 can comprise a plurality of focusing lenses arranged parallel to the pixels of the detector 36 along a line. By way of example, each pixel can be assigned exactly one optical element 38 that directs the light coming from the valuable document 22 onto the corresponding pixel. The line of pixels of the detector 36, the line of focusing lenses and/or, if appropriate, the extruded optical element 38 can be arranged for example parallel to the longitudinal direction of the sensor unit 28 and/or perpendicular to the longitudinal direction of the valuable document 22.

Figure 3:
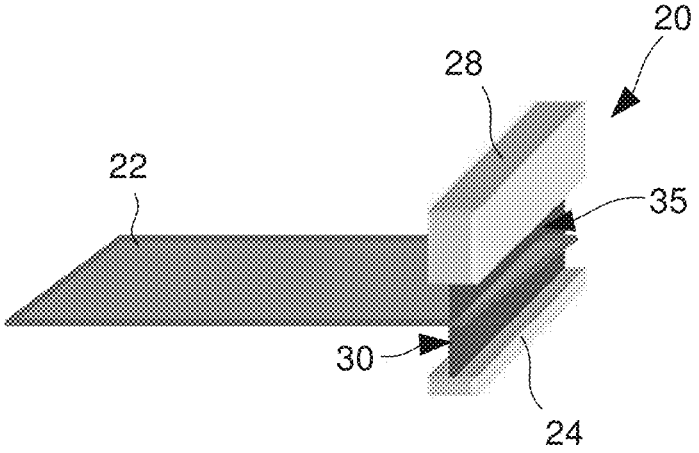
FIG. 3 shows a perspective illustration of one exemplary embodiment of a device for testing a valuable document with transmissive illumination.

FIG. 3 shows a perspective illustration of one exemplary embodiment of a device 20 for testing a valuable document. The device 20 for testing the valuable document 22 may for example largely correspond to the device 20 for testing the valuable document 22 explained above. In the exemplary embodiment shown in FIG. 3, just one illumination unit 24 is arranged on a side of the valuable document 22 facing away from the sensor unit 28. The illumination unit 24 illuminates the valuable document 22 by means of the illumination light. At least part of the illumination light 30 passes through the valuable document 22 and the corresponding transmission light 35 impinges on the detector 36 of the sensor unit 28. By means of the illumination unit 24, the valuable document 22 can be illuminated in transmitted light.

Figure 4:
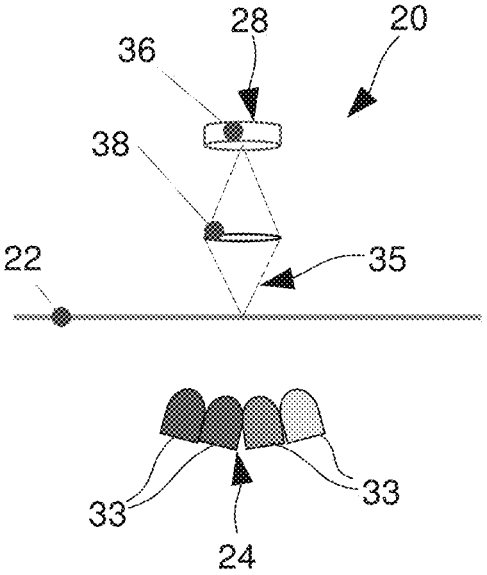
FIG. 4 shows a lateral schematic illustration of the device for testing a valuable document with transmissive illumination in accordance with FIG. 2.

FIG. 4 shows a lateral schematic illustration of the device 20 for testing the valuable document 22 in accordance with FIG. 3. It is evident from FIG. 4 that the first illumination unit 24 in this exemplary embodiment comprises at least four light sources 33. In another exemplary embodiment, however, the first illumination unit 24 can also comprise more or fewer light sources 33. The four light sources 33 may each be representative of a line of light sources 33, wherein the corresponding lines extend into the line plane. By way of example, the lines of light sources 33 are arranged parallel to a longitudinal direction of the first illumination unit 24 and/or perpendicular to a longitudinal direction of the valuable document 22.

In addition to the components explained above, the devices 20 for testing the valuable document 22 as explained with reference to FIGS. 1 to 4 each comprise a control unit, a data processing unit and an evaluation unit. The control unit is coupled to the illumination units 24, 26, the sensor unit 28, the data processing unit and the evaluation unit in such a way that it can control them and in particular can send signals to them and/or can receive signals from them. The data processing unit and the evaluation unit can also be parts of the control unit.

The data processing unit is coupled to the sensor unit 28 in such a way that it can receive data from the sensor unit 28. The data are representative of the light detected by means of the sensor unit 28. The data processing unit comprises at least one, preferably two or more resolution reducers, by means of which the data can be processed in such a way that an image of the valuable document 22 that is generated from the data has a lower resolution than an image of the valuable document 22 that is generated from the data and was not processed by means of the resolution reducer(s).

Figure 5:
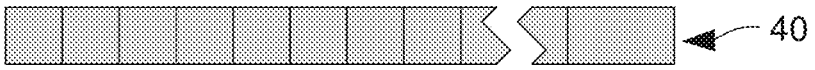
FIG. 5 shows a schematic illustration of one exemplary embodiment of a line of pixels of a detector.

FIG. 5 shows a schematic illustration of one exemplary embodiment of a line of pixels of a detector, for example of the above-explained detector 36 of the sensor unit 28. The pixels are arranged alongside one another in linear form. The line of pixels is also referred to hereinafter as detector line 40.

Figure 6:
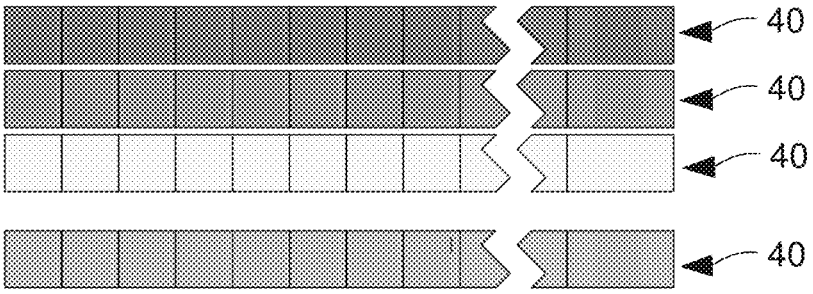
FIG. 6 shows a schematic illustration of the line of pixels of the detector in accordance with FIG. 5 under various illuminations.

FIG. 6 shows a schematic illustration of the line of pixels of the detector 36 in accordance with FIG. 5 under various illuminations, wherein the illumination of the detector 36 is not effected directly but rather indirectly via the valuable document 22. In particular, the detector 36 is illuminated by means of the light reflected from the valuable document 22 or by means of the light transmitted through the valuable document 22. FIG. 6 does not show a plurality of detector lines 40 at the same point in time, but rather the same detector line 40 at different points in time. In particular, FIG. 6 shows one below another the detector line 40 on one occasion under illumination with light of a first wavelength, for example with red light, on one occasion under illumination with light of a second wavelength, for example with green light, on one occasion under illumination with light of a third wavelength, for example yellow light, and on one occasion under illumination with light of a fourth wavelength, for example blue light or infrared light.

Figure 7:
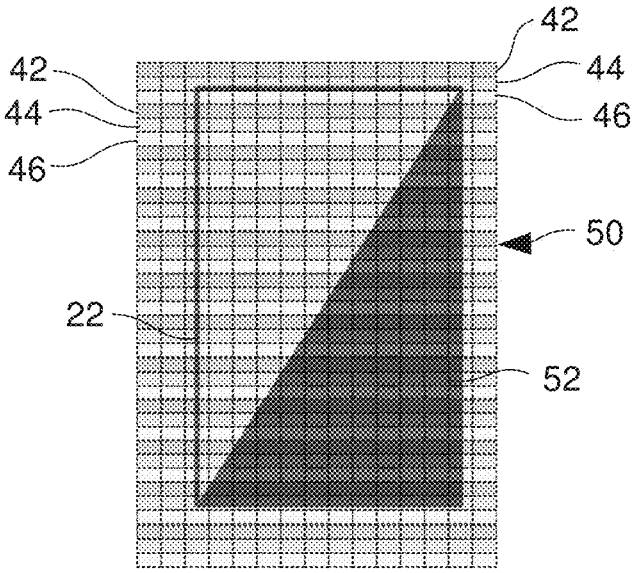
FIG. 7 shows a schematic illustration of one example of a valuable document under various illuminations.

FIG. 7 shows a schematic illustration of one example of a valuable document under various illuminations, for example of the above-explained valuable document 22 under a periodically changing illumination in accordance with the three upper detector lines 42 shown in FIG. 6. In particular, while the valuable document 22 is moved relative to the device 20 for testing the valuable document 22, said valuable document is illuminated alternately with red light, green light and yellow light, wherein this process is repeated until the entire valuable document 22 has been illuminated. Observation of the valuable document 22 during this process reveals that lines of different colours form successively on the valuable document 22, as is illustrated schematically in FIG. 7. In particular, FIG. 7 shows one below another the lines 42, 44, 46 of the valuable document 22, in particular first lines 42 under illumination with light of a first wavelength, for example with red light, therebelow second lines 44 under illumination with light of a second wavelength, for example with green light, and third lines 46 under illumination with light of a third wavelength, for example yellow light. This order of the lines 42, 44, 46 is repeated until the valuable document 22 has been completely illuminated.

The first lines 42 form a first group of the lines 42, 44, 46, the second lines 44 form a second group of the lines 42, 44, 46 and the third lines 46 form a third group of the lines 42, 44, 46. The first lines 42 can also be referred to as red lines. The second lines 44 can also be referred to as green lines. The third lines 46 can also be referred to as yellow lines. It should be understood here that the lines 42, 44, 46 of the valuable document 22 in reality are not illuminated simultaneously, but rather successively. The schematic illustration in FIG. 7 thus does not show a real image of the valuable document 22 under various illuminations, but rather presents an illustration of the temporal sequence of the illumination of the valuable document 22.

Moreover, FIG. 7 shows that the valuable document 22 has identification features 52, which are illustrated schematically by means of a large triangle for better elucidation in FIG. 7.

Figure 8:
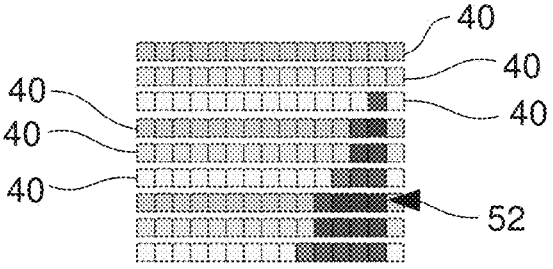
FIG. 8 shows an illustration of the line of pixels of the detector when detecting the light from the valuable document in accordance with FIG. 7.

FIG. 8 shows an illustration of the line of pixels of the detector 36 when detecting the light from the valuable document in accordance with FIG. 7. In particular, FIG. 8 shows one below another repeatedly the detector line 40 under the illumination in accordance with FIGS. 6 and 7. It is evident here that in the case of the upper two detector lines in FIG. 8, the identification feature 52 is not yet identifiable, but is detected by an increasing number of pixels in the underlying detector lines 40 in accordance with the triangular structure of the identification feature 52. In a manner similar to FIG. 6, FIG. 8 does not show a plurality of detector lines 40 at the same point in time, but rather the same detector line 40 at different points in time.

Figure 9:
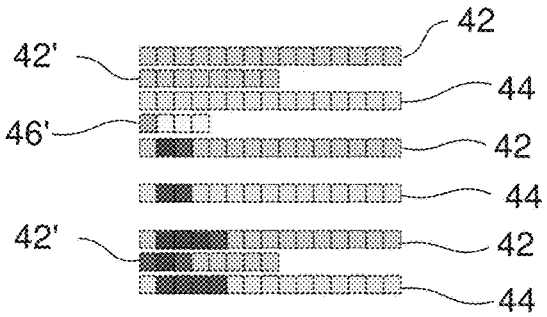
FIG. 9 shows an illustration of processed data generated by means of the lines of pixels of the detector when detecting the light from the valuable document in accordance with FIG. 7.

FIG. 9 shows an illustration of processed data on the basis of the lines 42, 44, 46 of the valuable document 22 in accordance with FIG. 7. In particular, FIG. 9 shows alternately one below another the first lines 42, reduced first lines 42', the second lines 44 and a reduced third line 46'. The reduced first lines 42' are generated by reducing the resolution of the first lines 42. The reduced third line 46' is generated by means of reducing the resolution of the recording of the corresponding third line 46, for example of the first third line 46 from the top as shown in FIG. 8. To put it generally, on the basis of the data representing the lines 42, 44, 46 it is possible to obtain data representing corresponding reduced lines, in particular by means of one or more resolution reducers.

Figure 10:
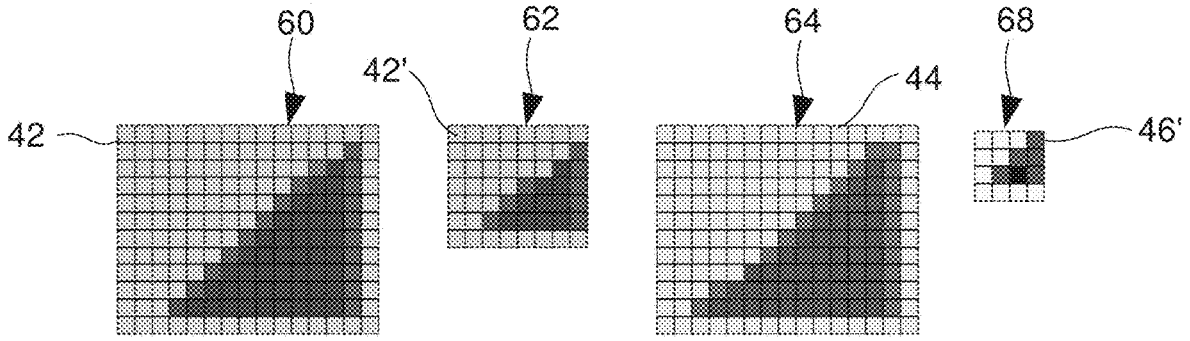
FIG. 10 shows images that are generated by means of the processed data in accordance with FIG. 9.

FIG. 10 shows images 60, 62, 64, 68 that can be generated for example by means of the processed data in accordance with FIG. 9.

In particular, a first image 60 having a first resolution can be generated by means of the data representing the first lines 42. The first resolution corresponds for example to a native resolution of the detector 36.

A second image 62 having a second resolution can be generated by means of the data representing the reduced first lines 42'. The second resolution is lower than the first resolution.

A third image 64 having a third resolution can be generated by means of the data representing the second lines 44, wherein the third resolution is equal to the first resolution in this exemplary embodiment.

A fourth image 68 having a fourth resolution can be generated by means of the data representing the third lines 46, wherein the fourth resolution is less than the first, second and third resolutions in this exemplary embodiment.

Consequently, a plurality of images 60, 62, 64, 68 of the valuable document 22 can be generated by means of the illumination units 24, 26 and the one detector line 40, wherein the images 60, 62, 64, 68 are generated in each case by means of light of a single colour, but overall are generated at least partly by means of light of different colours and have at least partly different resolutions.

All the images 60, 62, 64, 68 show the identification feature 52 in the corresponding resolution for simple illustration. In reality, however, valuable documents 22 often have different identification features 52. The illumination scheme and the resolutions of the images 60, 62, 64, 68 can be chosen depending on the valuable document 22 to be tested in such a way that they are particularly expedient, for example optimal, for identifying the corresponding identification feature 52. By way of example, the resolution necessary for identifying a first identification feature is lower than that necessary for identifying a second feature. If the low resolution is then actually used for identifying the identification feature, then in this way the data processing can be carried out particularly rapidly and particularly simply and thus with particularly low computing power. Alternatively or additionally, for identifying a second identification feature it may be sufficient to use only a portion of the lines of a specific colour, for example a portion of the first lines 42. If the small number of lines is then actually used for identifying the identification feature, then in this way the data processing can be carried out particularly rapidly and particularly simply and thus with particularly low computing power.

Figure 11:
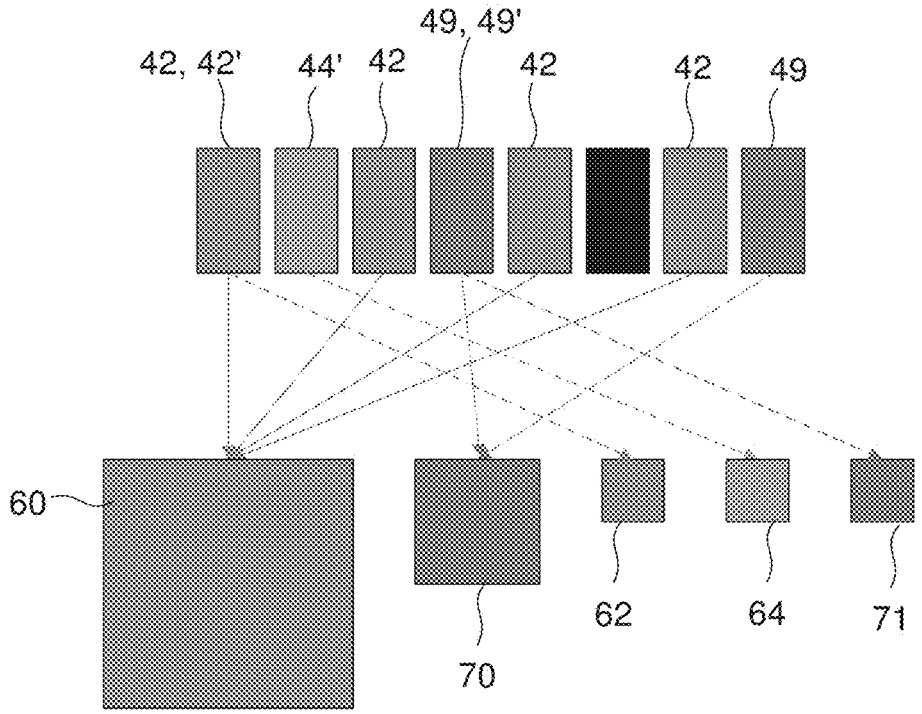
FIG. 11 shows an illustration of generation of different images on the basis of differently processed data using reflective illumination.

FIG. 11 shows an illustration of generation of different images 60, 62, 64, 70, 71 on the basis of differently processed data. In this case, the lines 42, 42', 44' and lines 49, 49' in the upper part of FIG. 11 are illustrated merely schematically as individual blocks. The images 60, 62, 64, 70, 71 illustrated underneath arise as a result of further transport of the valuable document 22, a plurality of repetitions of the illumination scheme represented by the lines 42, 42', 44' and lines 49, 49', by detection of the corresponding for example reflected light and processing of the corresponding data, in a manner similar to that as illustrated with the aid of FIGS. 6 to 10. In other words, the scheme shown in FIG. 11 represents, in a greatly simplified manner, the fundamental scheme illustrated with reference to FIGS. 6 to 10, wherein at least partly other lines, colours and/or resolutions are used.

In particular, FIG. 11 shows that the first image 60 having the first resolution is generated by means of the first lines 42 and that first reduced lines 42' are generated by means of the first lines 42 on the far left in FIG. 11. The second image 62 having the second resolution is generated by means of the first reduced lines 42'. Second reduced lines 44' are generated by means of the second lines 44. By means of the second reduced lines 44', the third image 64 is generated, although with a reduced resolution. A fifth image 70 having a fifth resolution and fourth reduced lines 49' are generated by means of fourth lines 49. A sixth image 71 having a sixth resolution is generated by means of the fourth reduced lines 49'. In this exemplary embodiment, the fifth resolution is less than the first resolution, but greater than the sixth resolution. Moreover, in this exemplary embodiment, the sixth resolution is equal to the second resolution and equal to the reduced resolution of the third image 64. One line, specifically the third from the right in FIG. 11, is not used.

In this exemplary embodiment, the first resolution can be for example 100 dpi×100 dpi, the fifth resolution can be for example 50 dpi×50 dpi and the second and sixth resolutions and also the reduced resolution of the third image 64 can be for example in each case 25 dpi×25 dpi. The native resolution can be for example 100 dpi×100 dpi.

The first lines 42 and the first reduced lines 42' can be generated for example by means of red illumination light. The second reduced lines 44' can be generated for example by means of green illumination light. The fourth lines 49 and the fourth reduced lines 49' can be generated for example by means of blue illumination light.

The illumination and processing scheme illustrated in FIG. 11 can be realized for example by means of a reflected-light illumination, as explained for example with reference to FIGS. 1 and 2.

Figure 12:
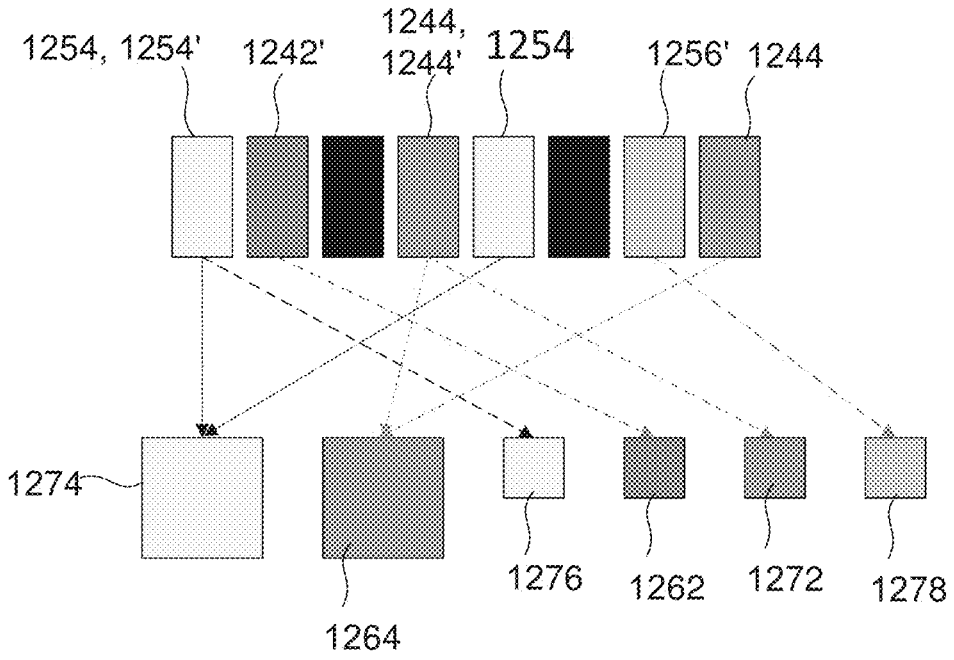
FIG. 12 shows an illustration of generation of different images on the basis of differently processed data using transmissive illumination.

FIG. 12 shows an illustration of generation of different images 1262, 1264, 1272, 1274, 1276, 1278 on the basis of differently processed data. In this case, the lines 1254, 1254', 1242', 1244, 1244', 1256' in the upper part of FIG. 12 are illustrated merely schematically as individual blocks. The images 1262, 1264, 1272, 1274, 1276, 1278 illustrated underneath arise as a result of further transport of the valuable document 22, a plurality of repetitions of the illumination scheme represented by the lines, by detection of the corresponding for example transmitted light and processing of the corresponding data, in a manner similar to that as illustrated with the aid of FIGS. 6 to 10. In other words, the scheme shown in FIG. 12 represents, in a greatly simplified manner, the fundamental scheme illustrated with reference to FIGS. 6 to 10, wherein at least partly other lines, colours and/or resolutions are used.

In particular, FIG. 12 shows that the first image 1274 having a first resolution is generated by means of the first lines 1254 and the second image 1276 having a second resolution is generated by means of first reduced lines 1254' formed from the first lines 1254. Furthermore, the third image 1262 having a third resolution is generated by means of second reduced lines 1242' formed from the second lines 1242. The fourth image 1264 having a fourth resolution is generated by means of the fourth lines 1244 and a fifth image 1272 having a fifth resolution is generated by means of fourth reduced lines 1244' formed from the fourth lines 1244. The first image 1274 having the first resolution is generated by means of the fifth lines 1254. A sixth image 1278 having a sixth resolution is generated by means of seventh reduced lines 1256' formed from the seventh lines 1256. The fourth image 1264 having the fourth resolution is generated by means of the eighth lines 1244. In this exemplary embodiment, the second resolution, the third resolution, the fifth resolution and the sixth resolution are equal in magnitude. Moreover, the first resolution and the fourth resolution are equal in magnitude and greater than the other resolutions. Two lines, specifically the third from the left and the third from the right in FIG. 12, are not used.

In this exemplary embodiment, the first resolution and the fourth resolution can be for example 50 dpi×50 dpi and the second resolution, the third resolution, the fifth resolution and the sixth resolution can be for example in each case 25 dpi×25 dpi. The native resolution can be for example 50 dpi×50 dpi.

The second reduced lines 1242' can be generated for example by means of red illumination light. The fourth lines 1244 and the fourth reduced lines 1244', and also the eighth lines 1244 can be generated for example by means of green illumination light. The first lines 1254 and the first reduced lines 1254' and also the fifth lines 1254 can be generated for example by means of yellow illumination light. The seventh reduced lines 1256' can be generated for example by means of infrared light in a first wavelength range.

The illumination and processing scheme illustrated in FIG. 12 can be realized for example by means of a transmitted-light illumination, as explained for example with reference to FIGS. 3 and 4.

Figure 13:
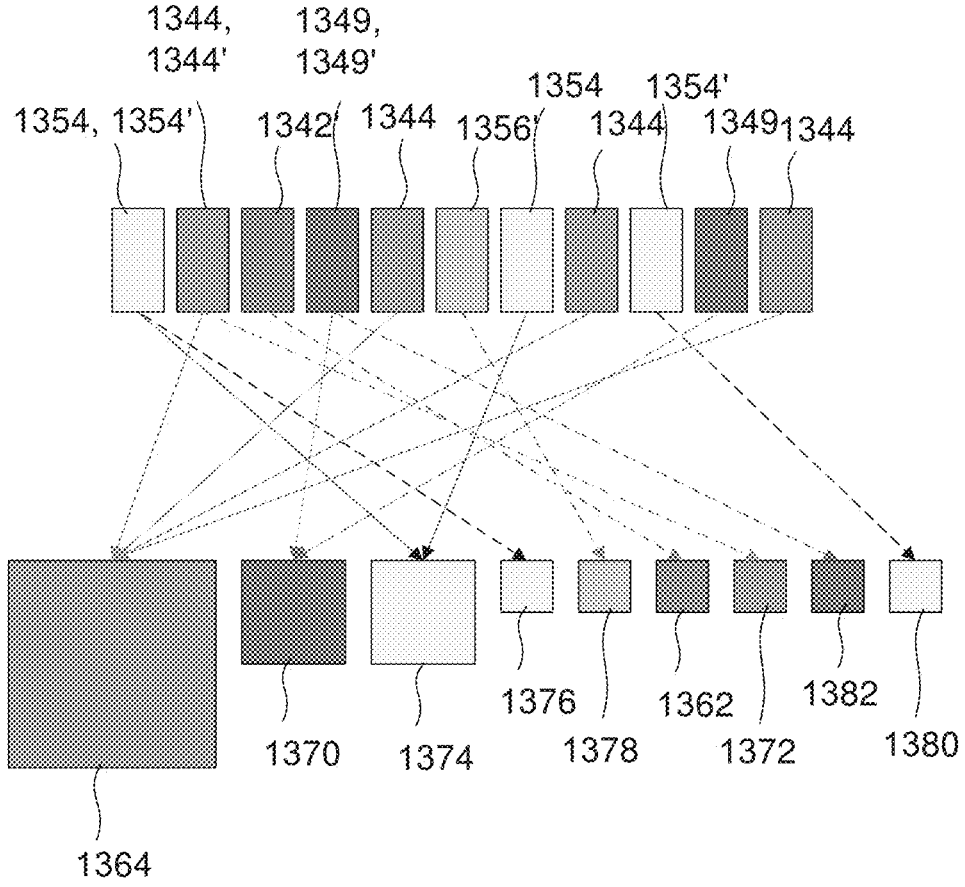
FIG. 13 shows an illustration of generation of different images on the basis of differently processed data using mixed reflective and transmissive illumination.

FIG. 13 shows an illustration of generation of different images 1362, 1364, 1370, 1372, 1374, 1376, 1378, 1380, 1382 on the basis of differently processed data. In this case, the lines 1342', 1344, 1344', 1349, 1349', 1354, 1354' and 1356' in the upper part of FIG. 13 are illustrated merely schematically as individual blocks. The images 1362, 1364, 1370, 1372, 1374, 1376, 1378, 1380, 1382 illustrated underneath arise as a result of further transport of the valuable document 22, a plurality of repetitions of the illumination scheme represented by the lines 1342', 1344, 1344', 1349, 1349', 1354, 1354' and 1356', by detection of the corresponding for example transmitted light and processing of the corresponding data, in a manner similar to that as illustrated with the aid of FIGS. 6 to 10. In other words, the scheme shown in FIG. 13 represents, in a greatly simplified manner, the fundamental scheme illustrated with reference to FIGS. 6 to 10, wherein at least partly other lines, colours and resolutions are used.

In particular, FIG. 13 shows that a first image 1374 having a first resolution is generated by means of the first lines 1354. Furthermore, a second image 1376 having a second resolution is generated by means of the first reduced lines 1354' formed from the first lines 1354. A third image 1364 having a third resolution and second reduced lines 1344' are generated by means of the second lines 1344. A fourth image 1372 having a fourth resolution is generated by means of the second reduced lines 1344'. A fifth image 1362 having a fifth resolution is formed by means of third reduced lines 1342' formed from third lines 1342. A sixth image 1370 having a sixth resolution is generated by means of fourth lines 1349. Furthermore, a seventh image 1382 having a seventh resolution is formed by means of fourth reduced lines 1349' formed from the fourth lines 1349. The third image 1364 having the third resolution is generated by means of the fifth lines 1344. An eighth image 1378 having an eighth resolution is generated by means of the sixth reduced lines 1356' formed from sixth lines 1356. The first image 1374 having the first resolution is generated by means of the seventh lines 1354. The third image 1364 having the third resolution is generated by means of the eighth lines 1344. A ninth image 1380 having a ninth resolution is generated by means of the ninth reduced lines 1354' formed from the ninth lines 1354. The sixth image 1370 having the sixth resolution is generated by means of the tenth lines 1349. The third image 1364 having the third resolution is generated by means of the eleventh lines 1344.

In this exemplary embodiment, the second resolution, the eighth resolution, the fifth resolution, the fourth resolution, the seventh resolution and the ninth resolution are equal in magnitude. Moreover, the sixth resolution and the first resolution are equal in magnitude and greater than the other resolutions mentioned above. The third resolution is the highest of all the resolutions.

In this exemplary embodiment, the third resolution can be for example 100 dpi×100 dpi, the sixth resolution and the first resolution can be for example 50 dpi×50 dpi, and the second resolution, the eighth resolution, the fifth resolution, the fourth resolution, the seventh resolution and the ninth resolution can be for example in each case 25 dpi×25 dpi. The native resolution can be for example 100 dpi×100 dpi.

The illumination and processing scheme illustrated in FIG. 13 can be realized for example by means of a combination of a reflected-light illumination, as explained for example with reference to FIGS. 1 and 2, and a transmitted-light illumination, as explained for example with reference to FIGS. 3 and 4.

Figure 14:
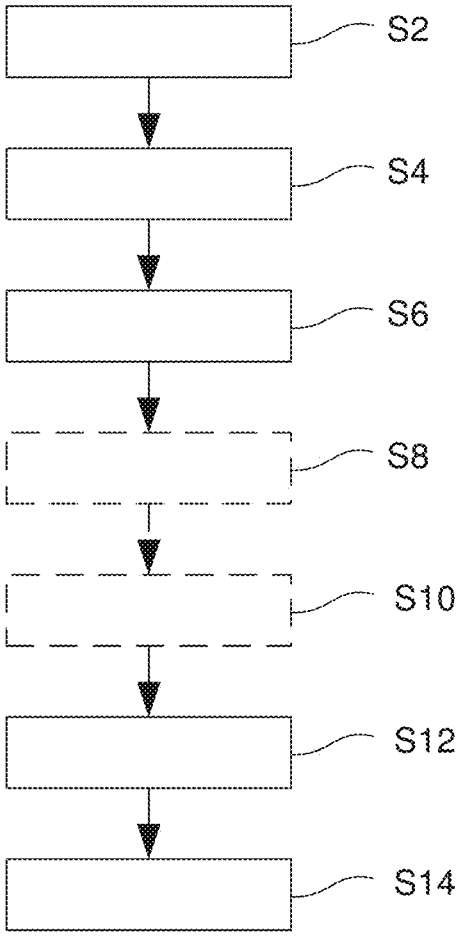
FIG. 14 shows a flow diagram of one exemplary embodiment of a method for testing a valuable document.

FIG. 14 shows a flow diagram of one exemplary embodiment of a method for testing a valuable document, for example the valuable document 22 explained above. The method for testing the valuable document 22 can be carried out for example with the aid of one of the above-explained devices 20 for testing the valuable document 22. For illustration, the method for testing the valuable document 22 is explained with the aid of FIGS. 7 to 13 besides the flow diagram shown in FIG. 14.

In a step S2, the valuable document 22 is illuminated line by line in such a way that a first group of lines of the valuable document 22 is illuminated with light of a first wavelength and that at least one second group of lines of the valuable document 22 is illuminated with light of a second wavelength, for example as explained in greater detail with reference to FIG. 7. At least partly lines of the first group and lines of the second group alternate. The first group of lines can be for example the first lines 42. The second group of lines can be for example the second or third lines 44, 46. For this purpose, the valuable document 22 is moved in a movement direction relative to the first and/or second illumination unit 24, 26, by means of which the valuable document is illuminated. In this case, the valuable document 22 is illuminated in such a way that the lines are aligned perpendicular to the movement direction. As a result, gradually the entire valuable document 22 is illuminated with progressive movement.

In a step S4, reflection light that is reflected from the lines and/or transmission light that passes through the lines are/is detected in a manner assigned to the lines of the first group and the lines of the second group and are/is converted into one, two or more electrical signals carrying corresponding data, for example as explained in greater detail with reference to FIG. 8. In this case, first data are representative of the reflection light and/or transmission light assigned to the lines of the first group, and second data are representative of the reflection light and/or transmission light assigned to the lines of the second group. Steps S2 and S4 can be processed successively or simultaneously.

In a step S6, the first data are processed in such a way that a first image generated from the first data, for example the first image 60 or the third image 64, has a first resolution, and the second data are processed in such a way that a further image generated from the second data, for example the fourth image 68 or second image 62, has a second resolution, which is different from the first resolution, for example as explained in greater detail with reference to FIGS. 9 and 10.

In an optional step S8, the first data can additionally be processed such that at least one second image generated from the first data, for example the second image 62, shows a smaller number of lines of the first group and has a resolution that is correspondingly lower than the first resolution, for example as explained in greater detail with reference to FIGS. 10 and 11.

In an optional step S10, the first data can additionally be processed such that at least partly first data of successive lines of the first group are averaged and that at least one second image generated from these averaged data, for example the second image 62 has a resolution that is lower than the first resolution. The step S10 can be processed as an alternative or in addition to step S8.

In a step S12, the first image 60 is compared with a first reference image and each further image is compared with a corresponding further reference image. By way of example, the second image 62 is compared with a corresponding second reference image.

In a step S14, depending on the comparison, a decision is taken as to whether the valuable document 22 is genuine and/or has a sufficient fitness to be able to continue in circulation. This can be carried out for example on the basis of deviations between the images and the corresponding reference images and a comparison of these deviations with predefined threshold values.

Expressed illustratively, in the method explained above, the data, which can also be referred to as camera data, are generated in a plurality of exposure colours with defined and configurable time-division multiplexing. Since different algorithms for testing the identification features require different minimum image resolutions and the sensor unit 28, which can also be referred to as a camera, and/or a processor, for example a CPU, of the device 20 in the case of conventional methods are/is often unable to yield or to process the maximum resolution for every exposure colour required, the data per colour and resolution are written directly via FPGA and DMA to a memory of the CPU into a dedicated 2D image memory area per valuable document 22.

In the FPGA, the following logic blocks can be used for this purpose: the sensor unit 28 detects the light and the corresponding data of the individual lines exposed with a specific colour, for example in the native resolution (100 dpi or 200 dpi), in a defined time frame (cycle length e.g. 12). Optionally, a correction of the corresponding gain and/or offset is carried out; at least one resolution reducer reduces the resolution of individual lines by a factor, for example by a factor of 2, 3, 4 or more or by a non-integral factor; and the outputs feed different DMA channels, which then construct the images of different resolutions and colours in the memory of the CPU.

A plurality of parallel resolution reducers can be arranged. The resolution reducers can be configured individually per line. In this regard, it is possible to use a line of a specific colour for example in an image having a resolution of 100 dpi and in an image having a resolution of 25 dpi. This process can also be referred to as colour reuse.

Here for example in the first case it is possible to use four 100 dpi lines per cycle and in the second case, for example, only one of these four lines can be used and/or be reduced to 25 dpi.

The invention is not restricted to the exemplary embodiments indicated. By way of example, in the case of the device 20, the illumination units 24, 26 can be arranged such that both a reflected-light illumination and a transmitted-light illumination are possible. Furthermore, the illumination units can comprise more or fewer light sources than those shown and/or more or fewer lines of light sources.

Furthermore, additional or fewer colours than those explained above can be used for the illumination. Furthermore, more or fewer images than those explained above can be generated and compared with corresponding reference images. Furthermore, the images can have different resolutions than those explained above. Furthermore, different illumination schemes than those explained above are possible.

What is claimed is:

1. A method for testing a valuable document, comprising:

illuminating a first group of lines of the valuable document with light of a first wavelength;

illuminating a second group of lines of the valuable document with light of a second wavelength, wherein the lines of the first group and the lines of the second group alternate;

detecting reflection light that is reflected from the lines of the first and second groups resulting in first data representative of the reflection light assigned to the lines of the first group and second data representative of the reflection light assigned to the lines of the second group;

processing the first data to generate a first image from the first data having a first resolution;

processing the second data to generate a second image generated from the second data having a second resolution, which is different from the first resolution;

comparing the first image with a first reference image; and comparing the second image with a second reference image.

2. The method according to claim 1, wherein the first image shows a first number of lines of the first group, and the first data are additionally processed such that a third image is generated from the first data showing a second number of lines, the second number being a smaller number of lines than the first number of lines of the first group, and the third image has a resolution that is lower than the first resolution, the third image then being compared with a third reference image.

3. The method according to claim 1, wherein the first data are additionally processed such that at least part of the first data including successive lines of the first group are averaged and that a third image is generated from the averaged data and has a third resolution which is lower than the first resolution, the third image then being compared with a third reference image.

4. The method according to claim 1, wherein the valuable document is moved in a movement direction relative to an illumination unit, by means of which the valuable document is illuminated, and the valuable document is illuminated in such a way that the lines are aligned perpendicular to the movement direction.

5. The method according to claim 1, wherein the first resolution or the second resolution corresponds to a native resolution of a detector for detecting the reflection light.

6. The method according to claim 1, wherein the valuable document is a banknote, a cheque, an identity card, a passport, a ticket or a share document.

7. The method according to claim 1, wherein the detecting further includes detecting transmission light that passes through the lines of the first and second groups in a manner assigned to the lines of the first group and the lines of the second group, wherein the first data is further representative of the transmission light assigned to the lines of the first group and the second data is further representative of the transmission light assigned to the lines of the second group.

8. A device for testing a valuable document, comprising:

an illumination unit for illuminating a first group of lines of the valuable document with light of a first wavelength and a second group of lines of the valuable document with light of a second wavelength, wherein the lines of the first group and the lines of the second group alternate;

a detector for detecting reflection light that is reflected from the lines of the first and second groups resulting in first data representative of the reflection light assigned to the lines of the first group and second data representative of the reflection light assigned to the lines of the second group;

a data processing unit for processing the first data to generate a first image from the first data having a first resolution, and for processing the second data to generate a second-image generated from the second data having a second resolution, which is different from the first resolution; and an evaluation unit, which compares the first image with a first reference image and compares the second image with a second reference image.

9. The device according to claim 8, wherein the first image shows a first number of lines of the first group, and wherein the data processing unit additionally processes the first data such that a third image is generated from the first data showing a second number of lines, the second number being a smaller number of lines than the first number of lines of the first group and has a resolution that is lower than the first resolution, and wherein the evaluation unit compares the third image with a third reference image.

10. The device according to claim 8, wherein the data processing unit additionally processes the first data such that at least part of the first data including successive lines of the first group are averaged and that a third image is generated from the averaged data and has a third resolution which is lower than the first resolution, and wherein the evaluation unit compares the third image with a third reference image.

11. The device according to claim 8, comprising a transport unit, by means of which the valuable document is moved in a movement direction relative to the illumination unit, wherein the valuable document is moved and illuminated in such a way that the lines are aligned perpendicular to the direction of movement.

12. The device according to claim 8, wherein the first resolution or the second resolution corresponds to a native resolution of the detector for detecting the reflection light.

13. The device according to claim 8, wherein the valuable document is a banknote, a cheque, an identity card, a passport, a ticket or a share document.

14. The device according to claim 8, the detector further for detecting transmission light that passes through the lines of the first and second groups in a manner assigned to the lines of the first group and the lines of the second group, wherein first data is further representative of the transmission light assigned to the lines of the first group and the second data is further representative of the transmission light assigned to the lines of the second group.

* * * * *